US012031807B2

(12) United States Patent
Soderstrom et al.

(10) Patent No.: US 12,031,807 B2
(45) Date of Patent: Jul. 9, 2024

(54) MECHANICAL BROADHEAD WITH ADJUSTABLE EXPANSION AND RELATED METHODS

(71) Applicants: Kristopher Jon Soderstrom, Raleigh, NC (US); Nicholas Demetrious Paliouras, Chapel Hill, NC (US)

(72) Inventors: Kristopher Jon Soderstrom, Raleigh, NC (US); Nicholas Demetrious Paliouras, Chapel Hill, NC (US)

( * ) Notice: Subject to any disclaimer, the term of this patent is extended or adjusted under 35 U.S.C. 154(b) by 0 days.

(21) Appl. No.: 18/097,692

(22) Filed: Jan. 17, 2023

(65) Prior Publication Data

US 2023/0235997 A1 Jul. 27, 2023

Related U.S. Application Data

(60) Provisional application No. 63/303,727, filed on Jan. 27, 2022.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 5,458,341 | A * | 10/1995 | Forrest | F42B 6/08 473/583 |
| 7,377,869 | B2 * | 5/2008 | Wohlfeil | F42B 6/08 473/583 |
| 9,303,963 | B1 * | 4/2016 | Ford | F42B 6/08 |
| 10,077,975 | B2 * | 9/2018 | Haas | F42B 6/08 |
| 10,436,556 | B1 * | 10/2019 | Ohlau | F42B 6/08 |
| 10,837,742 | B2 * | 11/2020 | Romero | F42B 6/08 |

* cited by examiner

*Primary Examiner* — John A Ricci
(74) *Attorney, Agent, or Firm* — Ashley D. Johnson; Dogwood Patent and Trademark Law

(57) ABSTRACT

The invention is a Mechanical Broadhead with adjustable expansion and related methods for using the mechanical broadhead are disclosed. According to an aspect, a mechanical broadhead includes a body that defines an interior space for holding the blades. The broadhead also includes an expansion adjustment mechanism. The blades each define a protrusion that extends substantially along a length of the body. The rotation of the first blade and the second blade extends in substantially opposing directions. The broadhead also includes a protruding member that prevents reverse rotation. The blade mechanisms comprise a resilient member that engages upon impact for starting rotation of the first and second blades after target penetration. The blade mechanisms comprise a blade tip member that engages after initial rotation for completing rotation. The adjustment feature prevents further rotation of the first and second blade to a desired blade expansion width.

11 Claims, 4 Drawing Sheets

MECHANICAL BROADHEAD WITH ADJUSTABLE EXPANSION AND RELATED METHODS

TECHNICAL FIELD

The presently disclosed subject matter relates generally to an arrow broadhead. Particularly, the presently disclosed subject matter relates to a mechanical broadhead with an adjustable blade expansion and related methods.

BACKGROUND

Bowhunting is a popular method of hunting where hunters primarily use Bows or Crossbows. The use of Bows rather than firearms has both advantages and drawbacks. In most states, the Bow season opens prior to firearm season which gives hunters the ability to extend their season. Additionally, using Bows to hunt are considered more challenging than firearms due to the reduced range of the projectile. Lastly Bows are silent and have a short range compared to a firearm therefore can be used in urban environments. Both Bows and Crossbows are typically rated by draw weight which can exceed over 400 lbs. The draw weight of a Crossbow, compared to a standard Bow, can be drastically larger thereby increasing both the potential distance and penetration of a projectile. In addition, Bowhunting differs from Rifle hunting wherein trauma caused by the arrow is reliant on blood loss rather than both blood loss and hydrostatic trauma that a bullet would induce. The broadhead of an arrow, used for hunting, incorporates sharp tip and sharp protrusions such as a razor blade. Historically, these blades have been fixed however recently there has been development of broadheads with blades are initially retracted then expand upon impact. In the retracted state, the aerodynamics drag is significantly less compared to a fixed blade, and when the broadhead impacts a target, the blades can expand to a larger diameter which will create a larger wound channel in the target. Current mechanical broadheads have limitations regarding the ability to inflict the most damage to the vital areas of the target which is in-between the rib cages. Some broadheads have blades that expend a lot of energy penetrating the rib cage rather than in the vital area. Some other broadheads over penetrate the target thereby not expelling the arrows energy to the vital area. Moreover, other existing mechanical broadheads, due to the design, have opening width limitations or the blade expansion is delayed after penetrating the target. Lastly, the expansion width of existing mechanical broadheads cannot be optimally adjusted based on the target distance, bow draw weight and the desired penetration of the target. It therefore would be beneficial to provide a mechanical broadhead that expands quickly after entering the target and has adjustable expansion to control penetration based on draw weight, distance to the target and the size of the target thereby transferring a majority the arrow's energy to vital areas.

BRIEF DESCRIPTION OF THE DRAWINGS

Figure 1A:
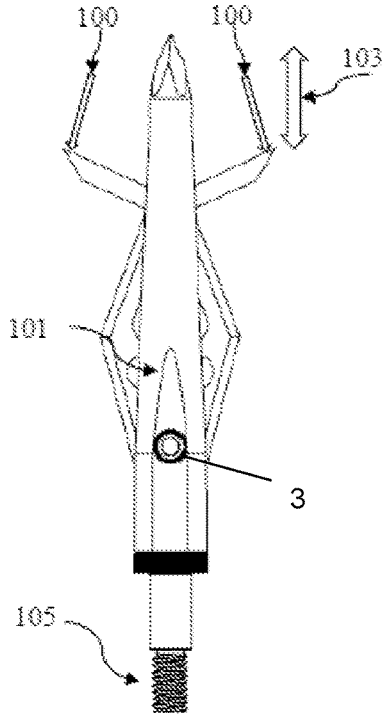

Having thus described the presently disclosed subject matter in general terms, reference will now be made to the accompanying Drawings, which are not necessarily drawn to scale, and wherein:

FIG. 1*a* illustrates a front view of a mechanical broadhead with adjustable expansion in accordance with embodiments of the present disclosure.

Figure 1B:
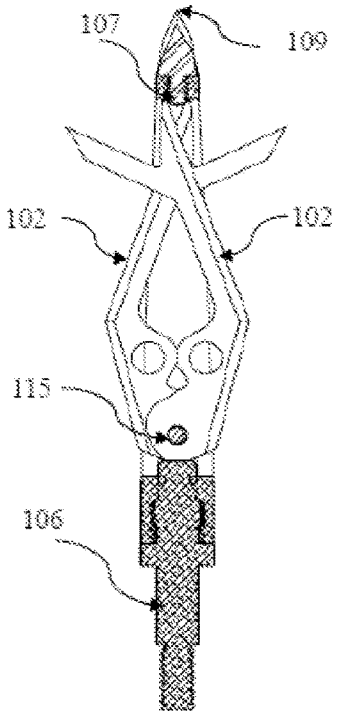

FIG. 1*b* illustrates a cross-sectional front view of the mechanical broadhead as shown in FIG. 1*a*.

Figure 1C:
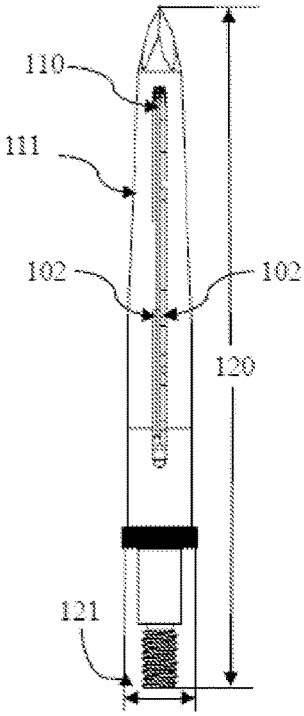

FIG. 1*c* illustrates a side view of the mechanical broadhead shown in FIG. 1*a* and FIG. 1*b*.

Figure 1D:
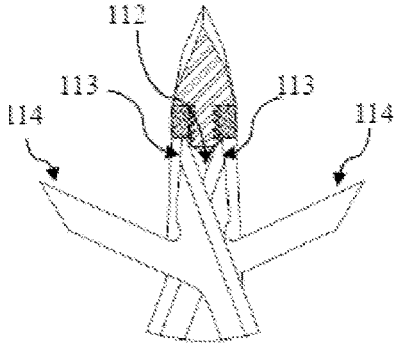

FIG. 1*d* illustrates a fragmented cross-sectional front view of the mechanical broadhead upper section shown in FIG. 1*b*.

Figure 1E:
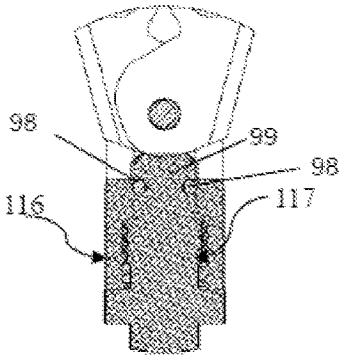

FIG. 1*e* illustrates a fragmented cross-sectional front view of the mechanical broadhead lower section shown in FIG. 1*b*.

Figure 1F:
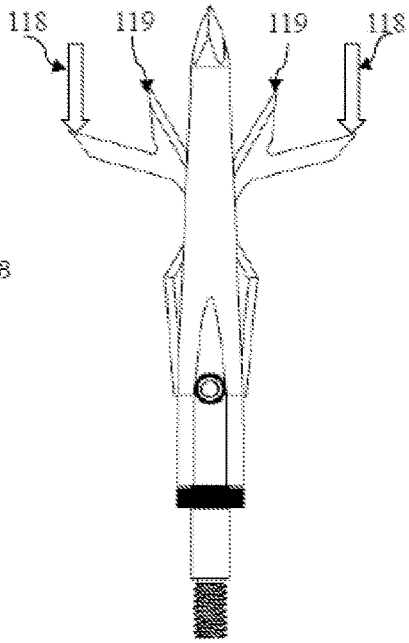

FIG. 1*f* illustrates a front view of the mechanical broadhead shown in FIG. 1*a* during initial expansion.

Figure 2A:
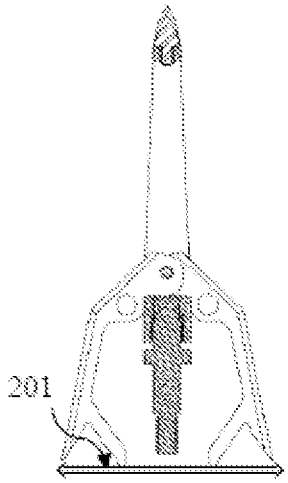

FIG. 2*a* illustrates a front cross-sectional view of the mechanical broadhead shown in FIG. 1*b* adjusted to the narrowest expansion width.

Figure 2B:
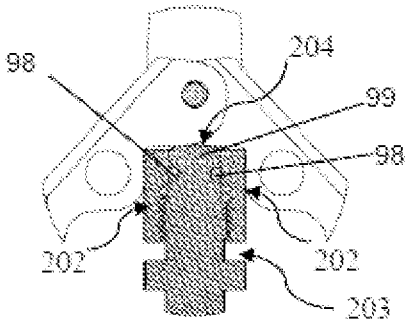

FIG. 2*b* illustrates a front fragmented cross-sectional view of the mechanical broadhead shown in FIG. 2*a* adjusted to the narrowest expansion width showing the adjustment apparatus.

Figure 2C:
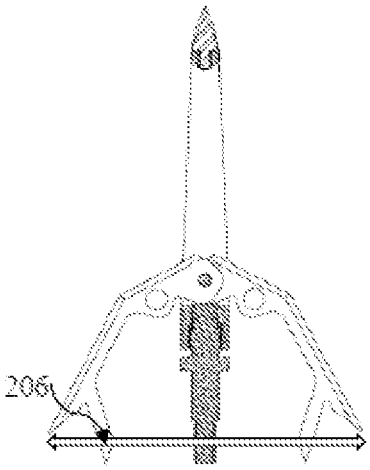

FIG. 2*c* illustrates a front cross-sectional view of the mechanical broadhead shown in FIG. 1*b* adjusted to a mid-expansion width.

Figure 2D:
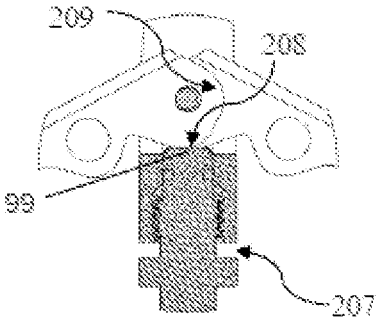

FIG. 2*d* illustrates a front fragmented cross-sectional view of the mechanical broadhead shown in FIG. 2*c* adjusted to a mid-expansion width showing the adjustment apparatus.

Figure 2E:
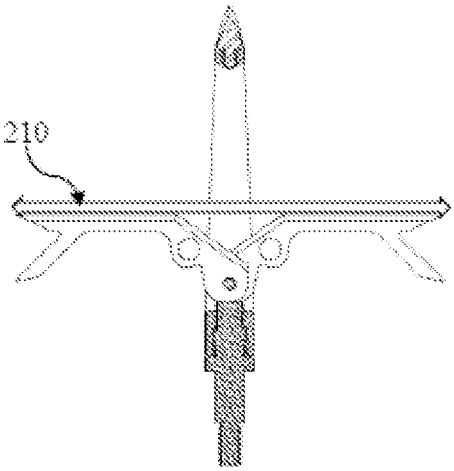

FIG. 2*e* illustrates a front cross-sectional view of the mechanical broadhead shown in FIG. 1*b* adjusted to the maximum expansion width.

Figure 2F:
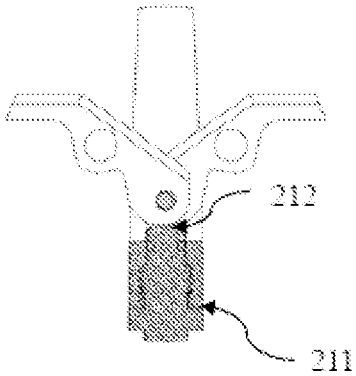

FIG. 2*f* illustrates a front fragmented cross-sectional view of the mechanical broadhead shown in FIG. 2*e* adjusted to the maximum expansion width showing the adjustment apparatus.

Figure 3:
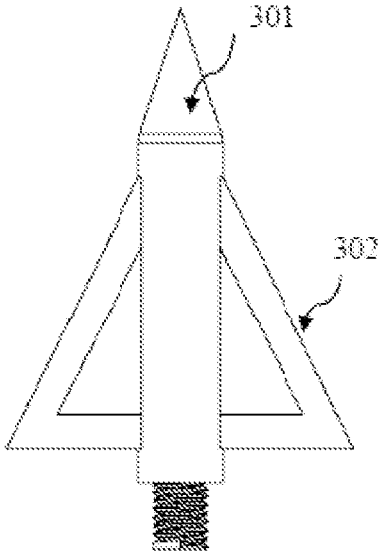
PRIOR ART Fig. 3

FIG. 3 illustrates a front view of a prior art fixed broadhead.

Figure 4A:
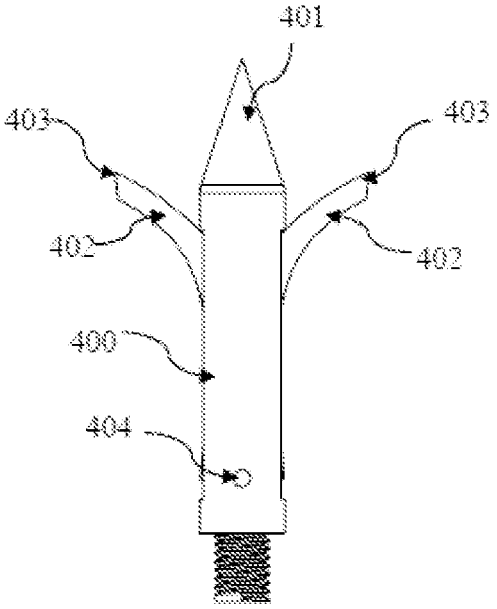
PRIOR ART Fig. 4a

FIG. 4*a* illustrates a front view of a second version of a prior art mechanical broadhead not expanded.

Figure 4B:
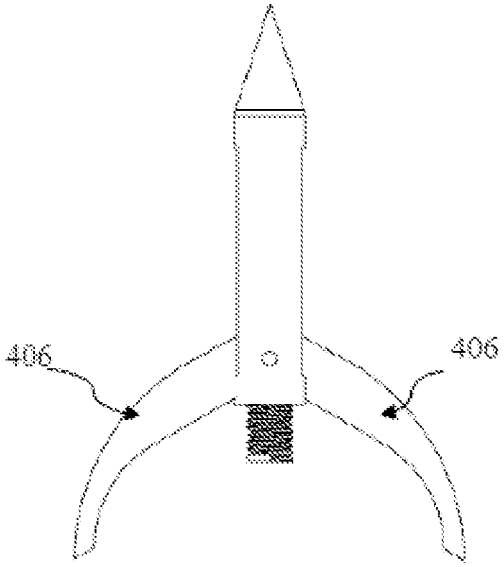
PRIOR ART Fig. 4b

FIG. 4*b* illustrates a front view of a second version of a mechanical broadhead shown in FIG. 4*a* fully expanded.

Figure 5A:
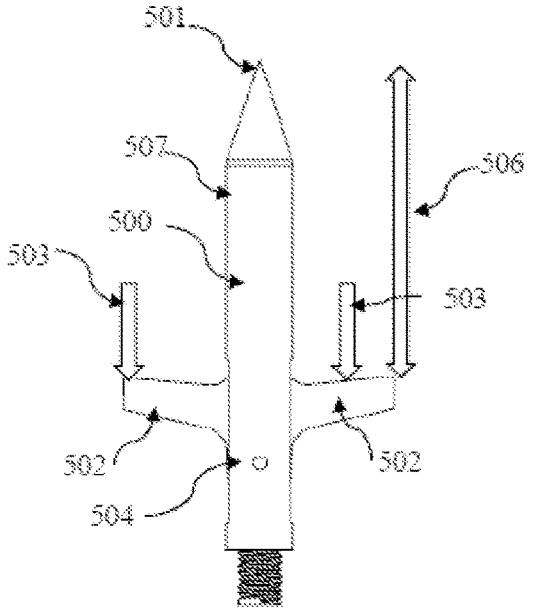
PRIOR ART Fig. 5a

FIG. 5*a* illustrates a front view of a third version of a prior art mechanical broadhead not expanded.

Figure 5B:
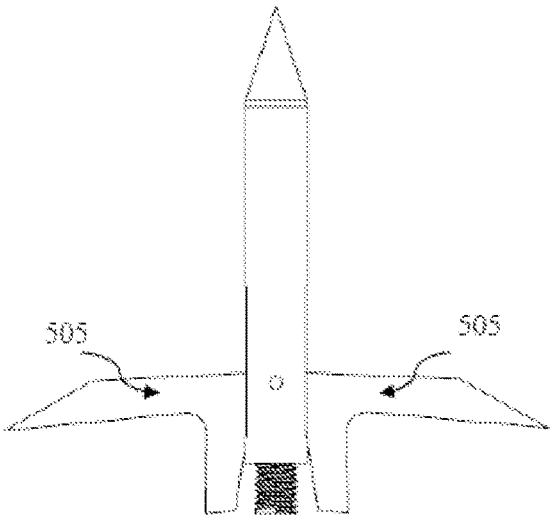
PRIOR ART Fig. 5b

FIG. 5*b* illustrates a front view of a third version of a mechanical broadhead shown in FIG. 5*a* fully expanded.

Figure 6A:
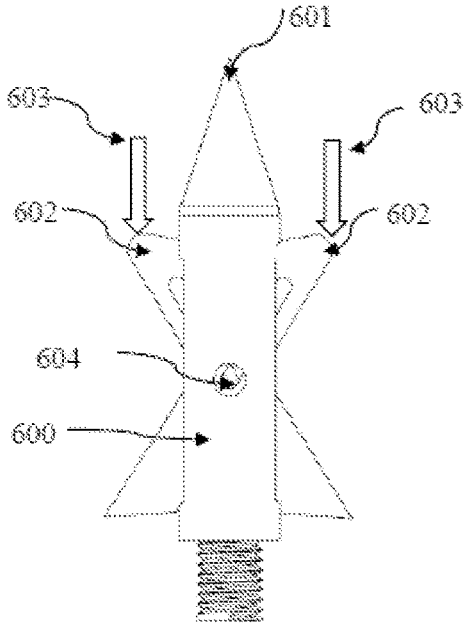
PRIOR ART Fig. 6a

FIG. 6*a* illustrates a front view of a fourth version of a prior art mechanical broadhead not expanded.

Figure 6B:
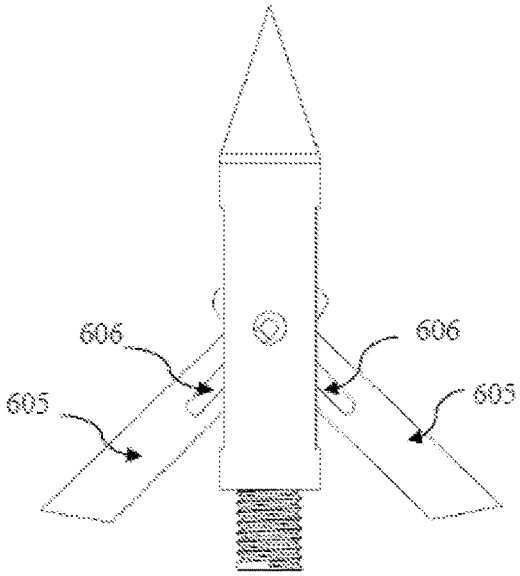
PRIOR ART Fig. 6b

FIG. 6*b* illustrates a front view of a fourth version of a mechanical broadhead shown in FIG. 6*a* fully expanded.

SUMMARY

The presently disclosed subject matter relates to a mechanical broadhead with adjustable expansion and related methods. According to an aspect, the presently disclosed subject matter is directed to a mechanical broadhead. Particularly, the mechanical broadhead comprises a body comprising an outer perimeter, an inner recess, a pointed tip, and threaded portions. The broadhead further includes at least one blade attached to the inner recess, wherein the blade can be recessed into the inner recess. The inner recess is sized and shaped to releasably receive a at least one blade attached to the body, such that the blade is positioned into a desired position in the inner recess. The inner recess contains a pivot point onto which the blade is attached to the body and allows the blade to be expanded outward from the inner recess. The broadhead further includes a base, that can be rotated, to adjust rotation of the blades therefore increasing or decreasing the expansion.

In some embodiments, the broadhead body comprises of an inner recess along the portion of the body.

In some embodiments, the body has pointed tip for penetration.

In some embodiments, the body has a threaded portion to attached to a base.

In some embodiments, the body has a threaded portion to facilitate adjustment of the expansion.

In some embodiments, the body has an internal threaded portion to control the amount of expansion.

In some embodiments, the body has a cavity to keep the tips of the blade from being exposed until after penetration.

In some embodiments, the body has a feature to prevent the blade from rotating in the wrong direction.

In some embodiments, the body has a feature to allow the blade to rotate about a pivot point.

In some embodiments, the base has external threads to connect to the body which allow for expansion adjustment.

In some embodiments, the base has an external thread to connect to an arrow.

In some embodiments, the base has a protruding member that controls the amount of blade expansion.

In some embodiments, the base has a knurled surface to help aid the rotation of the body relative to the base.

In some embodiments, blade is recessed inside the inner recess of the body.

In some embodiments, blade is extended outside of the inner recess of the body.

In some embodiments, the blade is sharp on one or more edges for cutting.

In some embodiments, the blade has a feature to allow initial rotation after the penetration.

In some embodiments, the blade has a feature to allow full rotation after the penetration.

In some embodiments, the blade has a pivot point.

In some embodiments, the blade has cam feature that controls for expansion by contacting the base's protruding member.

In some embodiments, the blade has a feature to start initial expansion.

In some embodiments, the presently disclosed subject matter is directed to a system comprising a mechanical broadhead with adjustable expansion. Particularly, the mechanical broadhead comprises a body comprising an outer perimeter, an inner recess, a pointed tip, and threaded portions. The broadhead further includes at least one blade attached to the body, wherein the blade can be retracted into the inner recess. The inner recess is sized and shaped to releasably receive a at least one blade attached to the body, such that the blade is positioned into a desired position in the inner recess. The inner recess contains a pivot point onto which the blade is attached to the body and allows the blade to be expanded outward from the inner recess. The broadhead further includes a base that can be rotated, to adjust rotation of the blades therefore increasing or decreasing the expansion.

In some embodiments, the system comprises of an inner recess along the portion of the body.

In some embodiments, the system has pointed tip for penetration.

In some embodiments, the system has a threaded portion to attached to an arrow.

In some embodiments, the system has threaded portions to facilitate adjustment of the expansion.

In some embodiments, the system has a feature to keep the tips of the blade from being exposed until after penetration.

In some embodiments, the system has a feature to prevent the blade from rotating in the wrong direction.

In some embodiments, the system has a feature to allow the blade to rotate about a pivot point.

In some embodiments, the system has blade that is recessed inside the inner recess of the body.

In some embodiments, the system has blade that extends outside of the inner recess of the body.

In come embodiments, the system has blade that is sharp on one or more edges for cutting.

In some embodiments, the system has blade that is has feature to allow initial rotation after the penetration.

In some embodiments, the system has blade that has a feature to allow full rotation after the penetration.

In some embodiments, the system has feature to prevent rotation from forces not including a target impact.

In some embodiments, the presently disclosed subject matter is directed to a method comprising a mechanical broadhead with adjustable expansion. Particularly, the mechanical broadhead comprises a body comprising an outer perimeter, an inner recess, a pointed tip, and threaded portions. The broadhead further includes at least one blade attached to the body, wherein the blade can be retracted into the inner recess. The inner recess is sized and shaped to releasably receive a at least one blade attached to the body, such that the blade is positioned into a desired position in the inner recess. The inner recess contains a pivot point onto which the blade is attached to the body and allows the blade to be expanded outward from the inner recess. The broadhead further includes an adjustment base, that can be rotated, to adjust rotation of the blades therefore increasing or decreasing the expansion In embodiments, a mechanical broadhead with adjustable expansion, includes a body that defines and inner recess for holding a blade. The broadhead includes a feature to conceal the blade tips until it enters the target. The broadhead also included a point for penetration and a threaded portion to secure it to an arrow and allow for adjustment of the expansion. The broadhead blade has a protrusion that prevents over rotation in either direction. The blade has a feature to start outward rotation after penetration. The blade has a feature that will continue full expansion after initial rotation.

In embodiments, a mechanical broadhead comprised of an adjustment mechanism comprising a thread that engages the body and base for changing the contact point of the base protrusion on the blades, and wherein the contact point between the base protrusion and the blade cam feature control wide the blade expands.

In embodiments, a mechanical broadhead comprised wherein the blades have a protrusion that extends outside of the inner recess along the length of the body, and wherein the protrusion of the blades that are exposed push the blades inward, rather than pulling the blades outward, to cause rotation until the blade tips become exposed wherein the target is contacted, and the rotation is completed. The pushing of the protrusion, rather than pulling the blades outward, allow the blades to expand in a shorter distance and allow for a larger blade, respectively.

In embodiments, a system, which includes an adjustable mechanical broadhead with an adjustment mechanism comprising a thread that engages the body for changing the contact point of the protrusion on the blades, and wherein the contact point controls how wide the blade expands.

In some embodiments, the presently disclosed subject matter is directed to a mechanical broadhead comprising: a body that defines an interior space; a cutting blade that is attached to the interior space of the body, comprising a first blade and a second blade, wherein the first and second blades rotate about an axis and extend in substantially opposing directions. The broadhead further includes a sharp penetrating tip positioned at a first end of the body, and a threaded member positioned at a second end of the body that connects the mechanical broadhead to an arrow. The mechanical broadhead is rotatable between a first position wherein the cutting blade is unexpanded within the interior space and a second position where the cutting blade is expanded and exterior to the interior space upon contact with a target.

In some embodiments, the mechanical broadhead includes an adjustment mechanism that enables a contact location of a protruding member on the first and second blades to be changed, and wherein the contact location controls how wide the cutting blade expands in the second position.

In some embodiments, the body comprises a cavity that conceals tips of the first and second blades, thereby allowing the mechanical broadhead to delay expansion in the second position until after the target has been penetrated.

In some embodiments, the cutting blade comprises a protruding feature that controls the distance at which expansion in the second position starts after the sharp penetrating tip penetrates the target.

In some embodiments, the presently disclosed subject matter is directed to a system comprising a mechanical broadhead and an arrow. The mechanical broadhead comprises a body that defines an interior space; a cutting blade that is attached to the interior space of the body, comprising a first blade and a second blade, wherein the first and second blades rotate about an axis and extend in substantially opposing directions. The broadhead further includes a sharp penetrating tip positioned at a first end of the body, and a threaded member positioned at a second end of the body that connects the mechanical broadhead to an arrow. The mechanical broadhead is rotatable between a first position wherein the cutting blade is unexpanded within the interior space and a second position where the cutting blade is expanded and exterior to the interior space upon contact with a target. The arrow is configured to accommodate the threaded member of the mechanical broadhead at one end.

In some embodiments, the presently disclosed subject matter is directed to a method of maximizing the effectiveness of a mechanical broadhead. Specifically, the method comprises adjusting blade expansion of a mechanical broadhead based on a bow draw weight, distance to a target, and size of the target. The mechanical broadhead includes a body that defines an interior space; a cutting blade that is attached to the interior space of the body, comprising a first blade and a second blade, wherein the first and second blades rotate about an axis and extend in substantially opposing directions. The broadhead further includes a sharp penetrating tip positioned at a first end of the body, and a threaded member positioned at a second end of the body that connects the mechanical broadhead to an arrow. The mechanical broadhead is rotatable between a first position wherein the cutting blade is unexpanded within the interior space and a second position where the cutting blade is expanded and exterior to the interior space upon contact with a target. The method comprises delaying expanding of the first and second blades in the second position until penetrating the target, expanding the first and second blades quickly after penetrating the target, adjusting the amount of expansion of the first and second blades to thereby maximize the energy from an arrow to which the mechanical broadhead is attached.

In some embodiments, adjusting the expansion is determined by the user of a bow that shoots the arrow.

In some embodiments, adjusting the blade expansion is performed by changing a contact location of a protruding member positioned on the first and second blades.

DETAILED DESCRIPTION

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +1-5%, in some embodiments +/−1%, in some embodiments +1-0.5%, and in some embodiments +/−0.1%, from the specified amount, as such variations are appropriate in the disclosed packages and methods.

As used herein, the term "and/or" includes any and all combinations of one or more 15 of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

The presently disclosed subject matter is generally directed to a mechanical broadhead that provides adjustable blade expansion. The term "broadhead" as used herein refers to a component mounted to one end of an arrow shaft that is capable of piercing a target (e.g., animal flesh or a stationary, filled shooting target in some embodiments). FIG. 1*a* through FIG. if illustrate one embodiment of a mechanical broadhead. Specifically, broadhead 101 comprises one or more blades 102 that allow expansion of the broadhead blades as desired by the user. In this way, the expansion can be adjusted, depending on a particular use of the broadhead. Advantageously, the blade expansion can be adjusted, as described in more detail herein below.

Broadhead 101 can be constructed from any desired rigid or semi-rigid material, such as (but not limited to) metal (e.g., stainless steel, aluminum, copper), polymeric material, wood, composite material, or combinations thereof.

Broadhead 101 can include any desired number of blades 102. For example, in some embodiments, the broadhead can include 1-10 blades (e.g., 1, 2, 3, 4, 5, 6, 7, 8, 9, or 10). However, the presently disclosed subject matter is not limited and the broadhead can have more than 10 blades. When broadhead 101 includes more than one blade, the blades can be arranged in parallel, as shown in FIG. 1*b*. However, the presently disclosed subject matter is not limited and the blades can be arranged in any configuration relative to another blade. However, blades 102 are not limited to parallel configurations, and can be angled relative to each other, not shown. The term "angled" can refer to any angle, such as an acute or obtuse angle. Thus, the blades can be angled relative to each other or to the horizontal or vertical at least about (or no more than about) 5, 10, 15, 20, 25, 30, 35, 40, 45, 50, 55, 60, 65, 70, 75, 80, 85, 90, 95, 100, 105, 110, 115, 120, 125, 130, 135, 140, 145, 150, 155, 160, 165, 170, 175, or 180 degrees. Thus, the blades can be configured in any way that allows for rotational movement in at least one direction.

Body 111 can have any desired height 120 and/or width 121, such as about 1-6 inches. Thus, each body can have a height and/or width of at least about (or no more than about) 1, 1.5, 2.0, 2.5, 3.0, 3.5, 4.0, 4.5, 5.0, 5.5, or 6 inches. However, the presently disclosed subject matter is not limited and the body can have a height and/or width greater or smaller than the ranges given herein.

Blade 102 can be configured in any desired length and width, depending on the length and/or width of the corresponding device. In some embodiments, blades 102 can span approximately the full length and/or width of body 111, as shown in FIG. 1*c*. The term "length" refers to the longest distance in the latitudinal direction. The term "width" refers to the longest distance perpendicular to the length. Alternatively, one or more blades can span about 10-95 percent the length and/or width of the body. Thus, the blades can span at least about (or no more than about) 10, 15, 20, 25, 30, 35, 40, 45, 50, 55, 60, 65, 70, 75, 80, 85, 90, or 95 percent of the length and/or width of body 101.

The disclosed broadhead provides many benefits and advantages. For example, the expansion width of the blade can be adjusted based on range, weapon draw weight and the size of the target.

Broadhead 101 does not expand until the tips of the blades 102 have entered the target thereby expelling more energy to the vital areas and allowing greater blade expansion.

Further, the disclosed broadhead width is easily adjustable by rotating a body 111 while base 106 remains static.

In addition, the disclosed broadhead expands quickly when entering the target as depicted by 103, compared to 506.

Because the blades 102 can be retracted into the body 111, the disclosed broadhead is more aerodynamic than fixed blade arrows such as 401.

Moreover, the design is simple to manufacture due to few components and simple subtractive manufacturing features.

FIG. 1*a* illustrates a front view of an adjustable expansion broadhead 101 having inner recess 110 for holding the blades in accordance with embodiments of the present disclosure. Referring to FIG. 1*a*, the mechanical broadhead 101 includes a body 111 that defines an interior recess 110 for holding at least one blade 102. The body 111 can include a pivot point 115 including screw 3 for the blade and a stopping feature 107 to prevent backwards rotation. Base 106 can be threaded onto body 101 to provide blade expansion adjustment. It should be appreciated that any method of attaching the body to the base can be used.

In this example, the broadhead 101 shown in FIG. 1*a* is sized and shaped for holding pivoting blades and described as such. However, the mechanical broadhead 101 may alternatively be suitably sized and shaped to hold any blades of different lengths, shapes, or quantity.

With continuing reference to FIG. 1*a* and FIG. 1*b*, mechanical broadhead can include a threaded portion 105 to attach it to an arrow. In addition, the body 111 includes a sharpened point 109. In this example, the broadhead includes two blades 102, but may alternatively include any suitable number of blades. Blades 102 extend substantially along a length of the body 111 between the upper end shown in FIG. 1*d* and lower end shown in FIG. 1*e*. In this example, blade 102 extends nearly the entire length between the upper end and the lower end.

FIG. 1*d* depicts one embodiment wherein body 111 includes a cavity 112 where blade tips 113 fully retract in the inner recess 110.

With continuing reference to FIG. 1*d*, the blades 102 have initial impact points 114 where blade tips 113, continue outward rotation after impact and allow the blade to fully expand.

FIG. 1*e* depicts the base 106 external threads 117 while the body 111 has external threads 116.

FIG. if depicts the blade 102 that has begun rotating after impact. In this example, when the broadhead 101 impacts a target (not shown) the point 109 pierces the target. The blade tips 113 are protected by cavity 112 where the blade's initial expansion begins when the target impacts protrusions 114. Force from the initial impact 100 on the blade protrusions 114 cause the blades to rotate outward as shown by FIG. if. Secondarily, expanding blade tips 119 continue rotation due to force 118 on the blade tips exerted by the target.

Referring to FIG. 1*a*, the distance at which expansion begins to occur 103 is the difference between blade tip 109 and blade impact points 114.

FIG. 2*a* and FIG. 2*b* illustrates a front section view of the mechanical broadhead adjusted to the narrowest expansion width. Width adjustment 201 is made by rotating body 111 relative to base 106. When rotated counterclockwise by distance 203, the blade expansion is stopped when the blade 102 impacts the location on the body 202. Base protruding member 204 is recessed in body 111 where it will not prohibit rotation of blades 102. Threads between the base 117 and body 116 allow for the adjustment to position 203. As shown, the protruding member includes impact cap 99 that contacts the blades. O ring 98 is positioned below the end cap, providing a sealing function and also adding friction to prevent movement after adjustment.

FIG. 2*c* and FIG. 2*b* illustrate a front cross-sectional view of the mechanical broadhead adjusted to a mid-expansion width. Width adjustment 206 is made by rotating body 111 relative to base 106. When rotated counterclockwise by distance 207, the blade expansion is stopped when the blade 102 impacts impact cap 99 of the protruding member 204 at location 208 on the blades. The cam shape of the blade 209 allows adjustment of any width between minimum expansion width 201 to maximum expansion width 210 by rotating body 111 about base 106.

FIG. 2*d* and FIG. 2*e* illustrate a front cross-sectional view of the mechanical broadhead adjusted to its maximum expansion width. Width adjustment 210 is made with by rotating body 101 relative to base 106. When body 111 is flush 211 with base 106 extruding member 204 is at its highest point. The blade expansion is stopped when the blade 102 impacts protruding member 204 at location 212 on the blades.

FIG. 3 illustrates a front view of a fixed blade broadhead 301 with a non-movable blade 302. Fixed blade broadhead 301 has a limitation on blade width 302, compared to a mechanical broadhead 101. The width of the blade increases drag and requires more force to enter a target specifically through a dense target such as hide and/or a rib cage. Moreover, the blade width is not adjustable.

FIG. 4*a* illustrates a front view of a second version of a mechanical broadhead 400 not expanded. The broadhead 400 contains a point 401, retracted blades 402, a pivot point 404 and a blade impact protrusion 403.

FIG. 4*b* illustrates a front view of a second version of a mechanical broadhead 400 expanded. The broadhead 400 contains a point 401, expanded blades 406 and a pivot point 404. This design is at a disadvantage where the blade expands before entering a target thereby limiting blade expansion and requiring more force to enter a target specifically through a dense target such as hide and/or a rib cage. Moreover, the blade width is not adjustable.

FIG. 5*a* illustrates a front view of a third version of a mechanical broadhead 500 un-expanded. The broadhead 500 contains a point 501, retracted blades 502 and a pivot point 504. The body contains and inner recess 507, similar to 112 where the blades are recessed in the body. The distance at which expansion occurs 506, similar to 103, is the difference between blade tip 501 and blade initial impact point 503.

FIG. 5*b* illustrates a front view of a third version of a mechanical broadhead 500 expanded. The broadhead 500 contains a tip 501, expanded blades 505 and a pivot point 504. This design is at a disadvantage where the blade begins to expand at distance 506 after entering the body cavity thereby limiting the amount of blade expansion. Moreover, the blade width is not adjustable.

FIG. 6*a* illustrates a front view of a fourth version of a mechanical broadhead 600 not expanded. The broadhead 600 contains a tip 601, retracted blades 602, a slide point 604 and a blade impact point 603.

FIG. 6*b* illustrates a front view of a fourth version of a mechanical broadhead expanded 607. The broadhead 607 contains a tip 601, expanded blades 605 and a slide point 604. Expanded blades 605, contain a slide 606 in the blade that slide rather than pivot to expand. This design is at a disadvantage where the blade expands before entering the target thereby limiting the blade expansion and requiring more force to enter a target specifically through a dense target such as hide and/or a rib cage. Moreover, the blade width is not adjustable.

While the embodiments have been described in connection with the various embodiments of the various figures, it is to be understood that other similar embodiments may be used, or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed is:

1. A mechanical broadhead comprising:

a body that defines an interior space;

a cutting blade that is attached to the interior space of the body, comprising a first blade and a second blade, wherein the first and second blades rotate about an axis and extend in substantially opposing directions;

a sharp penetrating tip positioned at a first end of the body;

a threaded member positioned at a second end of the body that connects the mechanical broadhead to an arrow, wherein the threaded member comprises a plurality of internal threads;

an adjustment mechanism that enables an impact cap positioned at a contact location of a protruding member on a base of the adjustment mechanism to be changed, and wherein the impact cap controls how wide the cutting blade expands in the second position;

wherein the mechanical broadhead is rotatable between a first position wherein the cutting blade is unexpanded within the interior space and a second position where the cutting blade is expanded and exterior to the interior space upon contact with a target.

2. The mechanical broadhead of claim 1, wherein the body comprises a cavity that conceals tips of the first and second blades, thereby allowing the mechanical broadhead to delay expansion in the second position until after the target has been penetrated.

3. The mechanical broadhead of claim 2, wherein said cutting blade comprises a protruding feature that controls the distance at which expansion in the second position starts after the sharp penetrating tip penetrates the target.

4. The mechanical broadhead of claim 1, wherein the body includes a pivot point comprising a screw.

5. A system comprising:

a mechanical broadhead comprising:

a body that defines an interior space;

a cutting blade that is attached to the interior space of the body and comprising a first blade and a second blade, wherein the first and second blades rotate around an axis and extend in substantially opposing directions;

a sharp penetrating tip positioned at a first end of the body;

a threaded member positioned at a second end of the body that connects the mechanical broadhead to an arrow, wherein the threaded member comprises a plurality of internal threads;

an adjustment mechanism that enables an impact cap positioned at a contact location of a protruding member on a base of the adjustment mechanism to be changed, and wherein the impact cap controls how wide the cutting blade expands in the second position; and wherein the mechanical broadhead is rotatable between a first position wherein the cutting blade is unexpanded within the interior space and a second position where the cutting blade is expanded external to the interior space upon contact with a target;

wherein the cutting blade is unexpanded within the interior space and a second position where the cutting blade is expanded exterior to the interior space upon contact with a target; and an arrow configured to accommodate the threaded member of the mechanical broadhead at one end.

6. The mechanical broadhead of claim 5, wherein the body comprises a cavity that conceals tips of the first and second blades, thereby allowing the mechanical broadhead to delay expansion in the second position until after the target has been penetrated.

7. The mechanical broadhead of claim 6, wherein the cutting blade comprises a protruding feature that controls the distance at which expansion in the second position starts after the sharp penetrating tip penetrates the target.

8. The system of claim 5, wherein the body includes a pivot point comprising a screw.

9. A method of maximizing the effectiveness of a mechanical broadhead, the method comprising:

adjusting blade expansion of a mechanical broadhead based on a bow draw weight, distance to a target, and size of the target, wherein the mechanical broadhead is defined as:

a body that defines an interior space;

a cutting blade that is attached to the interior space of the body and comprising a first blade and a second blade, wherein the first and second blades rotate around an axis and extend in substantially opposing directions;

a sharp penetrating tip positioned at a first end of the body;

a base comprising a threaded member positioned at a second end of the body that connects the mechanical broadhead to an arrow; and an adjustment mechanism that enables an impact cap positioned at a contact location of a protruding member on a base of the adjustment mechanism to be changed, and wherein the impact cap controls how wide the cutting blade expands in the second position;

wherein the mechanical broadhead is rotatable between a first position wherein the cutting blade is unexpanded within the interior space and a second position where the cutting blade is expanded external to the interior space upon contact with a target; and delaying expanding of the first and second blades in the second position until penetrating the target, expanding the first and second blades quickly after penetrating the target, adjusting the amount of expansion of the first and second blades to thereby maximize the energy from an arrow to which the mechanical broadhead is attached.

10. The method of claim 9, wherein adjusting the expansion is determined by the user of a bow that shoots the arrow.

11. The method of claim 9, wherein adjusting the blade expansion is performed by changing a contact location of a protruding member positioned on the base.

* * * * *